US006871594B1

(12) United States Patent
Estrella

(10) Patent No.: US 6,871,594 B1
(45) Date of Patent: Mar. 29, 2005

(54) REUSABLE PAINT GRENADE

(76) Inventor: Randall P. Estrella, 5320 West Ave. M-2, Quartz Hill, CA (US) 93536

( * ) Notice: Subject to any disclaimer, the term of this patent is extended or adjusted under 35 U.S.C. 154(b) by 169 days.

(21) Appl. No.: 10/405,582

(22) Filed: Apr. 1, 2003

(51) Int. Cl.[7] ..... F42B 8/00

(52) U.S. Cl. ..... 102/498; 102/368; 102/513; 446/401; 446/473; 473/577

(58) Field of Search ..... 102/368, 498, 102/513; 446/401, 473; 273/457; 473/577; 124/56

(56) References Cited

U.S. PATENT DOCUMENTS

| | | | | | |
|---|---|---|---|---|---|
| 3,492,945 | A | * | 2/1970 | Filippi | 102/498 |
| 3,878,639 | A | * | 4/1975 | Scheelar et al. | 446/473 |
| 4,319,426 | A | * | 3/1982 | Lee | 446/401 |
| 4,684,137 | A | * | 8/1987 | Armer et al. | 473/609 |
| 4,690,061 | A | * | 9/1987 | Armer et al. | 102/401 |
| 4,932,672 | A | * | 6/1990 | Tippmann | 473/611 |
| 4,944,521 | A | * | 7/1990 | Greeno | 473/577 |
| 5,018,449 | A | * | 5/1991 | Eidson, II | 102/498 |
| 5,240,450 | A | * | 8/1993 | Graham | 446/267 |
| 5,354,225 | A | * | 10/1994 | Hix | 446/180 |
| 5,553,741 | A | | 9/1996 | Sancoff et al. | |
| 5,590,886 | A | * | 1/1997 | Lush | 473/577 |
| 5,877,448 | A | | 3/1999 | Denton et al. | |
| 5,996,503 | A | * | 12/1999 | Woodall et al. | 102/498 |
| 6,289,819 | B1 | * | 9/2001 | Dolderer | 102/513 |
| 6,453,819 | B1 | * | 9/2002 | Coates | 102/498 |
| 6,499,477 | B1 | * | 12/2002 | Brock | 124/56 |
| 6,598,807 | B1 | * | 7/2003 | Anzalone | 239/302 |
| 6,688,234 | B2 | * | 2/2004 | Huber et al. | 102/498 |

* cited by examiner

*Primary Examiner*—Michael J. Carone
*Assistant Examiner*—Troy Chambers
(74) *Attorney, Agent, or Firm*—Charles H. Thomas

(57) ABSTRACT

A reusable paint dispersing grenade of the type employed in paint ball games is constructed in such a manner as to avoid the use of any combustible materials, and also to avoid the requirement for access to a source of compressed air for operation. The paint grenade of the invention has a hollow, fluid-tight casing defining an enclosed cavity that is divided internally into a marking paint chamber, a first propellant component chamber, and a second propellant component chamber. The propellant component chambers are each filled separately with propellant components, but remain isolated from each other until the paint dispersing grenade is used. At that time the propellant components chemically react with each other in a noncombustible manner to produce a quantity of gas under pressure. The expanding gas produced by the chemical reaction builds to a pressure sufficient to break a paint seal in the casing or a gas seal initially separating the gas from the paint, whereupon the gas under pressure forces the paint out through one or more paint expulsion ports. The device may be recharged with marking paint and the chemically reactive propellant components any number of times.

18 Claims, 11 Drawing Sheets

REUSABLE PAINT GRENADE

BACKGROUND OF THE INVENTION

1. Field of the Invention

The present invention relates to a reusable paint grenade that can be thrown during mock combat and which ejects marking paint that simulates the effective range of a grenade explosion.

2. Description of the Prior Art

In recent years the use of paint guns to shoot paint balls and paint grenades to simulate hand grenades in war games and other mock combat situations has become increasing popular. In this connection paint dispersing grenades are employed as devices which are filled with marking paint and which can be thrown to a location remote from the user with the intent of splattering an opponent with paint and thereby eliminating the opponent from a recreational paint ball game. The generally accepted rules of paint ball games preclude any participant from continuing to play upon receiving a paint marking. Paint ball games have become increasingly popular as a sport or recreation that simulates combat situations, but in a nonlethal manner.

Paint grenades that have been employed are designed for either a single use or they may be reusable. Paint grenades designed for a single use are quite economical to fabricate, but have considerable disadvantages in use as paint ball grenades. Such onetime use grenades may be constructed much in the manner of a water balloon. A thin balloon envelope is filled with paint, rather than water, and thrown at an opponent when a player believes there is a reasonable likelihood for scoring a hit. However, paint grenades designed for a single use are quite likely to break even before they are thrown. They must be handled quite carefully, and also cannot be thrown with any degree of accuracy remotely approaching that of an actual hand grenade.

Reusable paint grenades have been designed to more realistically simulate the use and effect of actual military ordinance hand grenades. For example, the concept of providing multiple projectiles or streams of paint from a reusable grenade is described in U.S. Pat. Nos. 6,453,819; 5,996,503; 5,590,886; 5,354,225; 5,018,449; 4,944,521; 3,492,945; 3,878,639; and 3,492,945. However, these and other prior paint ball grenades have certain disadvantages.

The grenade disclosed in U.S. Pat. No. 3,492,945 uses a pyrotechnic propellant for expelling the marking paint. Such pyrotechnic devices present a fire hazard and are not allowed on most public paint ball game sites.

The grenades disclosed in U.S. Pat. Nos. 3,878,639 and 5,354,225 must be charged with compressed air from an external source. As a consequence, it is not possible to rapidly refill and reuse such grenades except at a source of compressed air.

The reusable paint grenades disclosed in U.S. Pat. Nos. 4,944,521 and 5,996,503 must have a cylinder of compressed gas and numerous paint balls must be replaced before reuse. These devices are not conducive for rapid recharging and reuse.

The reusable paint grenade disclosed in U.S. Pat. No. 6,453,819 must be refilled with a multiplicity of paint balls. Also, this device involves two gas-producing chemicals for a time-delayed actuation. It must also be charged with compressed air from an external source. This device requires major disassembly to reset its operating mechanism. As a consequence, it is impractical for refilling and reuse during a simulated combat paint ball game.

The reusable paint grenades disclosed in U.S. Pat. Nos. 5,018,449 and 5,590,886 utilize coiled springs to crush containers of paint. However, these devices are quite complex in construction.

SUMMARY OF THE INVENTION

The present invention involves a reusable paint grenade suitable for use in mock combat paint ball games. The reusable paint grenade of the invention has a hollow fluid-tight casing formed of releaseably separable body parts. The casing has a plunger port at one end and at least one, and preferably a plurality of paint ejection ports at the opposite end. A movable barrier is disposed entirely across the hollow interior cavity of the casing that divides the interior into a marking paint chamber and a section in which propellant components are located. These propellant components are respectively located within first and second propellant component chambers that are separated from each other by a breachable propellant seal until the grenade is to be thrown. A plunger is located in the plunger port. The plunger initially protrudes from the casing, but may be forced into the casing to break the fluid-tight seal between the two propellant components.

Two mutually reactive chemicals within the propellant section of the casing are isolated from each other until the fluid-tight barrier therebetween is breached. A plunger is preferably provided with a cutting element that pierces the barrier between the two reactive components, allowing them to mix within the propellant section of the casing.

The propellants employed chemically react with each other, but in a noncombustible manner. To the contrary, they react to produce a harmless propellant gas under pressure, such as carbon dioxide. The reactive components are quite economical and are not toxic. For example, vinegar and baking soda may be utilized as the propellant components.

The amount of the expandable gas that is produced is sufficient to produce a considerable gas pressure within the hollow cavity of the grenade casing. The rapid buildup of gas pressure acts against the movable barrier between the propellant section and the paint storage chamber, causing it to shift to exert a compressive force upon the marking paint within the casing. Indeed, the pressure buildup of gas within the propellant section of the casing acts upon the paint/propellant barrier to create a very considerable pressure upon the incompressible marking paint located within the paint storage chamber. This pressure builds until it is sufficient to break the paint seal that has theretofore existed between the paint storage chamber and the paint ejection port or ports of the casing. Once the paint seal breaks, the expanding gas within the rigid grenade casing forces an eruption of paint in streams out through the paint ejection ports.

The propellant component isolation barrier between the propellant chemicals may be breached in any convenient manner. For example, the barrier between the propellant components may be a rupturable or frangible barrier. Alternatively, it may be a barrier which may be mechanically displaced and forced out of a blocking position by movement along a passageway in response to depression of the plunger. The barrier also can be formed by a spring-loaded poppet valve on a seat. Other arrangements are also possible.

Preferably, at least one of the propellant components is provided in liquid form. The first propellant component may be an acid, an acid anhydride, or an acid salt. In the preferred embodiment of the invention the first propellant component is comprised of vinegar, which includes acetic acid. The second propellant component is preferably a group 1 or 11 metal carbonate or bicarbonate, and may be formed of sodium bicarbonate.

The grenade casing is preferably comprised of releaseably interengageable mating body members that can be easily separated from each other to facilitate refilling the enclosed cavity of the casing with paint and propellant chemicals for subsequent reuse. Preferably the body members are both concave, generally cup-shaped structures that have open mouths that can be screwed together. When attached in this manner a fluid-tight seal is formed by an O-ring entrapped between the body members.

One primary object of the present invention is to provide a reusable paint grenade that does not involve combustion for actuation. As a consequence, the contents of the grenade do not present a fire hazard.

A further object of the invention is to provide a reusable paint grenade that does not require a source of compressed air from an external source for recharging. Consequently, the reusable grenade of the present invention may be utilized at any location within the field of play of a paint ball game.

A further object of the invention is to provide a reusable paint grenade which does not require replacement of a compressed gas cylinder with each use. Gas cylinders of this type are rather expensive. In contrast, the recharging materials employed in the reusable paint grenade of the present invention are very economical in cost.

A further object of the invention is to provide a reusable paint grenade which can be rapidly refilled for reuse. This is preferably achieved by packaging the reactive propellant components within a single cartridge that includes an internal propellant component isolation barrier. This cartridge is positioned in the enclosed cavity of the hollow casing, preferably immediately adjacent the paint storage chamber. The cartridge is located in the path of movement of a plunger. Depression of the plunger into the casing breaches the barrier between the reactive components, thereby allowing them to mix to produce a gas that expands within the finite confines of the casing to expel the paint from the grenade casing.

A further object of the invention is to provide a reusable paint grenade in which gas pressure is produced in a noncombustible manner by a chemical reaction within the structure of the grenade. Still another object of the invention is to provide a paint grenade which is of very simple construction and which may easily be recharged.

In one broad aspect the present invention may be considered to be a reusable paint grenade comprising a rigid, reusable casing defining a hollow cavity therewithin and defining at least one paint ejection port and a plunger port. The hollow cavity is subdivided into a paint storage chamber, a first propellant component storage chamber, and a second propellant component storage chamber. A fluid-tight paint/propellant separates the paint storage chamber from the first propellant component storage chamber. A fluid-tight propellant component storage isolation barrier separates the first and second propellant component storage chambers from each other.

First and second propellant components are located respectively in the first and second propellant storage chambers. The first and second propellant components, when mixed, react together without combustion to form a gas that is under pressure in the casing.

A plunger is mounted in the casing and projects from the plunger port. The plunger is directed toward the second propellant component storage chamber. As a consequence, depression of the plunger into the casing breaches the propellant component isolation barrier. A breachable paint seal separates the paint storage chamber from the paint ejection port or ports.

The invention may be described with greater clarity and particularity by reference to the accompanying drawings.

DESCRIPTION OF THE EMBODIMENTS

Figure 1:
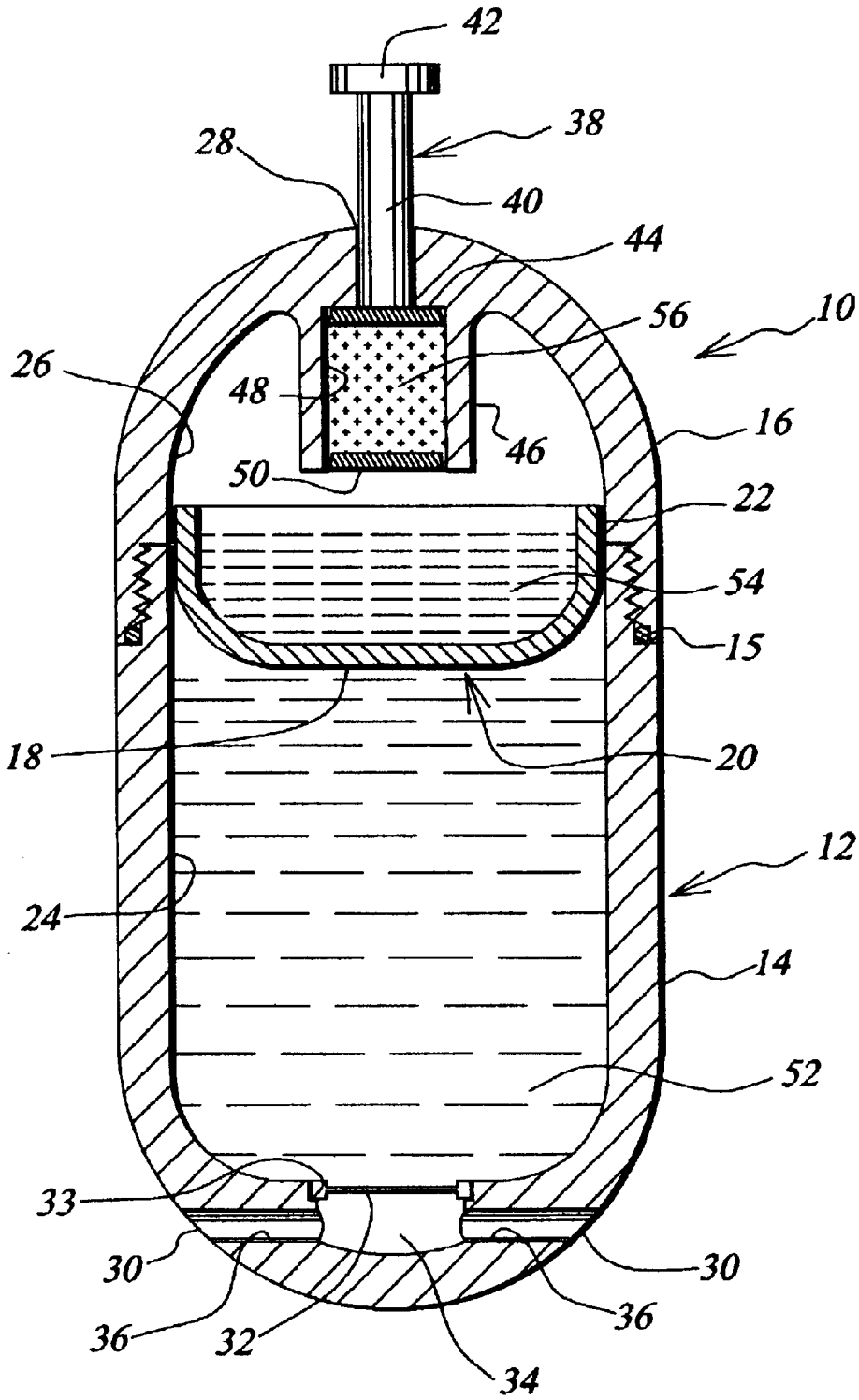
FIG. 1 is an elevational sectional view of one preferred embodiment of a reusable paint grenade according to the invention loaded in preparation for use.

FIG. 1 illustrates a reusable paint dispersing grenade 10 constructed according to the invention and comprising a hollow casing 12 which is formed from a pair of mating, releaseably engageable, generally cup-shaped body members 14 and 16. The casing 12 is an oblong structure rounded hemispherically at both of its opposite ends. The body members 14 and 16 are of rigid construction and may be fabricated of ABS, PVC, Delrin, or any other rigid plastic material. Alternatively, they can be fabricated of metal, such as steel or aluminum. They can also be made of any number of other rigid, fluid impermeable materials.

The body member 14 is equipped with male threads that are threadably engageable with corresponding female threads defined on the body member 16. An annular rubber O-ring 15 is entrapped between the body members 14 and 16 and forms a fluid-tight seal therebetween when the body members 14 and 16 are screwed together.

The casing 12 is further formed with a plunger port 28 at one end of the casing 12 through the otherwise closed end of the body member 16. At least one, and preferably several, paint expulsion ports 30 are defined in the casing 12 at the otherwise closed end of the body member 14. A paint plenum chamber 34 is connected to the ports 30 by several paint ejection ducts 36.

The paint grenade 10 includes a movable, fluid-tight paint/propellant barrier, which is formed as the floor 18 of a shallow, cup-shaped structure 20 having a cylindrical, annular surrounding side wall 22 rising from the floor 18. The cup-shaped structure 20 may be formed of any slightly resilient material, including, but not limited to, rubber, Teflon®, or polyethylene. It could alternatively be fabricated from a rigid plastic or metal with a rubber-O-ring. In either case it forms a sliding seal with the interior wall of the body member 14. The floor 18 of the cup-shaped structure 20 delineates a paint storage chamber 24 from a first propellant component storage chamber 26 within the cavity defined within the enclosure of the hollow casing 12.

The paint grenade 10 is further comprised of a breachable paint seal 32 that extends across the mouth of the plenum cavity 34 leading to the paint ejection ports 30. The paint seal 32 may be a thin, rupturable or frangible plastic disc having a peripheral rim set into a corresponding recess at the bottom of the paint storage chamber 24 to form a fluid-tight seal against a bearing ledge 33 within the body member 14.

The paint grenade 10 also includes a plunger 38 comprised of a cylindrical piston rod 40 that extends through the plunger port 28 in the casing 12. The piston rod 40 has a diameter such that it will glide smoothly through the structure of the body member 16 adjacent the plunger port 28. The plunger 38 also includes an enlarged plunger head or button 42 located externally of the casing 12 and a piston 44 that is located within the casing 12 and which is mounted for longitudinal movement within a cylindrical, annular well or barrel 46 formed within the hollow cavity of the casing 12. The cylindrical volume located within the lateral confines of the barrel 46 of the propellant section of the casing cavity forms a second propellant component storage chamber 48.

The piston 44 of the plunger 38 is directed into the second propellant component storage chamber 48. The barrel 46 is formed as a cylindrical, annular tubular structure projecting from the inside surface of the upper end of the body member 16 longitudinally toward the cup 20. The piston 44 resides in sliding, fluid-tight, sealed engagement against the internal, cylindrical wall of the barrel 46. The plunger 38 is mounted within the cavity formed within the hollow casing 12 and protrudes from the plunger port 28 of the casing 12.

A generally disc-shaped, resilient plug 50 is inserted into the longitudinal interior extremity of the cylindrical, annular barrel 46 when the paint grenade 10 is loaded. The plug 50 serves as a fluid-tight propellant component isolation barrier within the hollow casing 12. The propellant component isolation barrier disc 50 delineates the second propellant component storage chamber 48 from the first propellant component storage chamber 26 forming the remainder of the propellant section of the cavity enclosed within the hollowing casing 12.

Both the piston 44 and the plug 50 may be rubber cup seals of the type commonly used in automotive hydraulic brake wheel cylinders. The sealing lips of both of these structures face downwardly toward the interior of the hollow cavity defined within the casing 12.

To prepare the paint grenade 10 for use, the body members 14 and 16 are unscrewed from each other and the body member 14 is disposed in the upright orientation illustrated in FIG. 1. The thin, fracturable diaphragm or membrane 32 forming the paint seal is inserted into the lower extremity of the body member 14 in a seated position on the ledge 33 immediately above the paint discharge plenum 34, as illustrated. A quantity of paint 52 is then poured into the paint storage chamber 24. The cup 20 is then inserted into the open mouth of the body member 14 facing concave upwardly with the floor 18 of the cup 20 resting atop the paint 52. The cup 20 is then filled with a first propellant component 54, preferably vinegar, which is largely comprised of acetic acid. The cylindrical, annular wall 22 of the cup 20 resides in a fluid-tight, sliding, sealed engagement with the internal cylindrical wall of the upper portion of the body member 14.

The plunger actuator button 42 is then withdrawn as far as possible from the plunger port 28 in the body member 16 so that the plunger piston 44 is moved as close as possible to the plunger port 28. The body member 16 is then inverted from the orientation illustrated in FIG. 1. A quantity of baking soda 56, which serves as the second propellant component is then poured into the open end of the barrel 46, on top of the plunger 44. Enough room is left in the barrel 46 to accommodate the thickness of the propellant isolating sealing plug 50. The propellant component isolating sealing plug 50 is then inserted into the open end of the barrel 46 to form a plug or stopper that separates the baking soda 56 from the vinegar 54. The plug 50 is resilient enough to form a fluid-tight seal against the internal wall of the barrel 46. Once the plug 50 is in position, the upper cup-shaped body member 16 is screwed onto the lower body member 14, as illustrated in FIG. 1.

Sufficient quantities of vinegar 54 and baking soda 56 are utilized as first and second propellant components, respectively, so that when these components are mixed, they chemically react to form a quantity of gas sufficient to exert a significant pressure within the propellant section 26 of the grenade casing cavity 12. However, as long as the plunger 38 remains withdrawn, the propellant isolating plug 50 will remain in position separating the baking soda 56 from the vinegar 54, even if the paint grenade 10 is inverted, jostled, and roughly handled.

The plunger barrel 46 is located internally within the casing 12 and is directed toward the first propellant component storage compartment 26 which is formed by the portion of the propellant section of the casing cavity that surrounds the barrel 46 and which is bounded by the cup 20. The plunger barrel 46 forms the second propellant component storage chamber 48 and is bounded by the plunger piston 44 and the fluid-tight propellant component isolation barrier plug 50. The barrier plug 50 is an ejectable, resilient plug that is positioned in the end of the barrel 46 remote from the plunger port 28. The rupturable paint seal 32 is positioned between the paint storage chamber 24 and all of the paint ejection ports 30.

The propellant component isolating plug 50 ensures that the first propellant component, namely the vinegar 54, remains located within the first propellant component storage chamber formed by the confines of the cup 20 and the portion of the body member 16 surrounding the barrel 46, while the second propellant component, namely the baking soda 56, remains confined within the second propellant component storage chamber formed by the internal cavity within the barrel 46. Meanwhile, the paint seal 32 ensures that the paint 52 does not prematurely escape through the paint expulsion ports 30.

Figure 6:
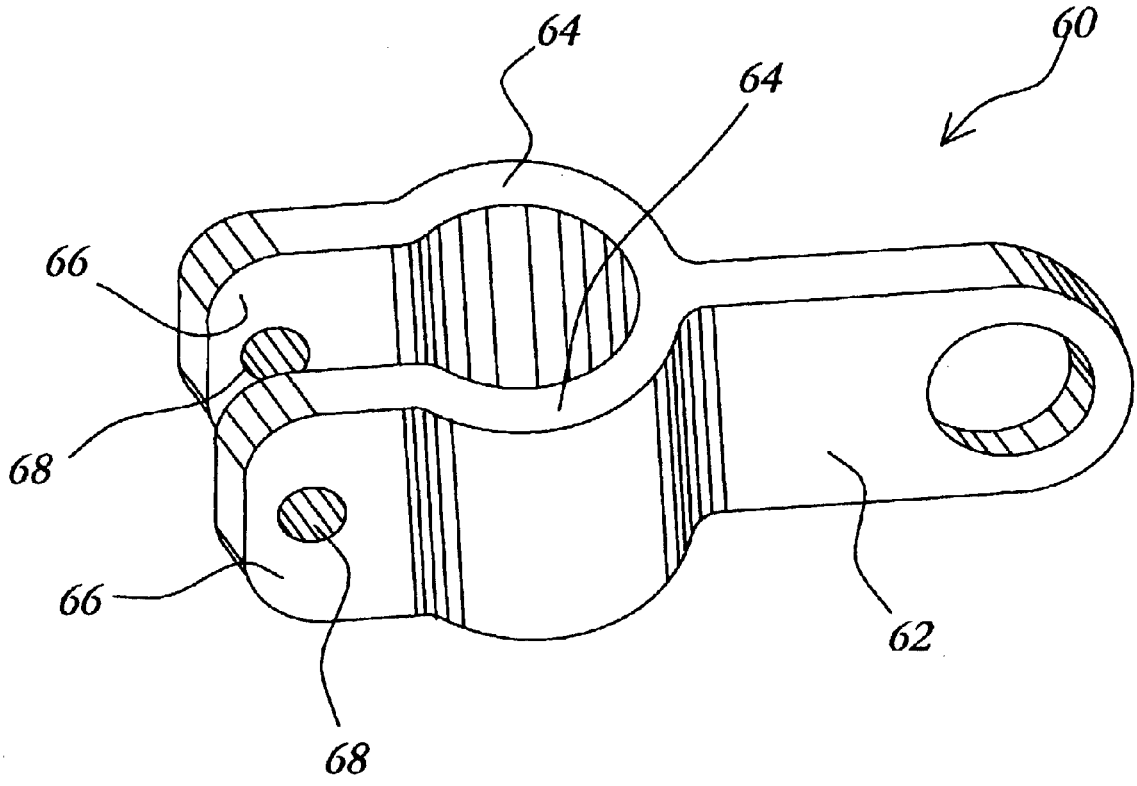
FIG. 6 is a perspective view of the safety clip employed in the paint grenades illustrated in FIGS. 1–4*d*.

To prevent premature activation of the paint grenade 10, it is advisable to utilize a safety clip, such as the safety clip 60 illustrated in isolation in FIG. 6. The safety clip 60 is a plunger-engaging device that is releaseably attachable to the plunger 38 to limit movement of the plunger 38 toward the second propellant storage chamber 48. The safety clip 60 is a small, plastic device that includes a pull tab 62 attached to a C-shaped clip portion having a pair of arcuate arms 64 that define a generally cylindrical opening therebetween. The arms 64 terminate in distal tabs 66 with coaxially aligned safety pin openings 68 defined therethrough. The gap between the tabs 66 is narrower than the diameter of the plunger rod 40, but the arms 64 are resilient enough so that when the tabs 66 are pressed toward the plunger rod 40, the arms 64 will resiliently spread so that the plunger rod 40 can enter the generally cylindrical space formed between the arms 64.

The arms 64 have a width considered in an axial direction relative to the casing 12 substantially equal to the exposed length of the plunger rod 40 when it is withdrawn as far as possible from the plunger port 28, as illustrated in FIG. 1. When the safety clip 60 is attached to the plunger 38, the arms 64 embrace the plunger rod 40 therebetween with the actuator button 42 bearing against the top sides of the safety clip arms 64, and with the exposed surface of the body member 16 surrounding the plunger port 28 bearing against the bottom sides of the safety clip arms 64. If desired, a rod-shaped safety pin can be inserted through the safety pin openings 68.

When the safety clip 60 is attached to the paint grenade 10 in this manner, the paint grenade 10 will not be actuated despite severe jostling or even if it is subjected to significant impact. However, when the user wishes to actuate the grenade 10, the safety clip 60 is removed, if a safety clip 60 is employed. The plunger button 42 is then depressed manually just before the paint grenade 10 is thrown.

Figure 2A:
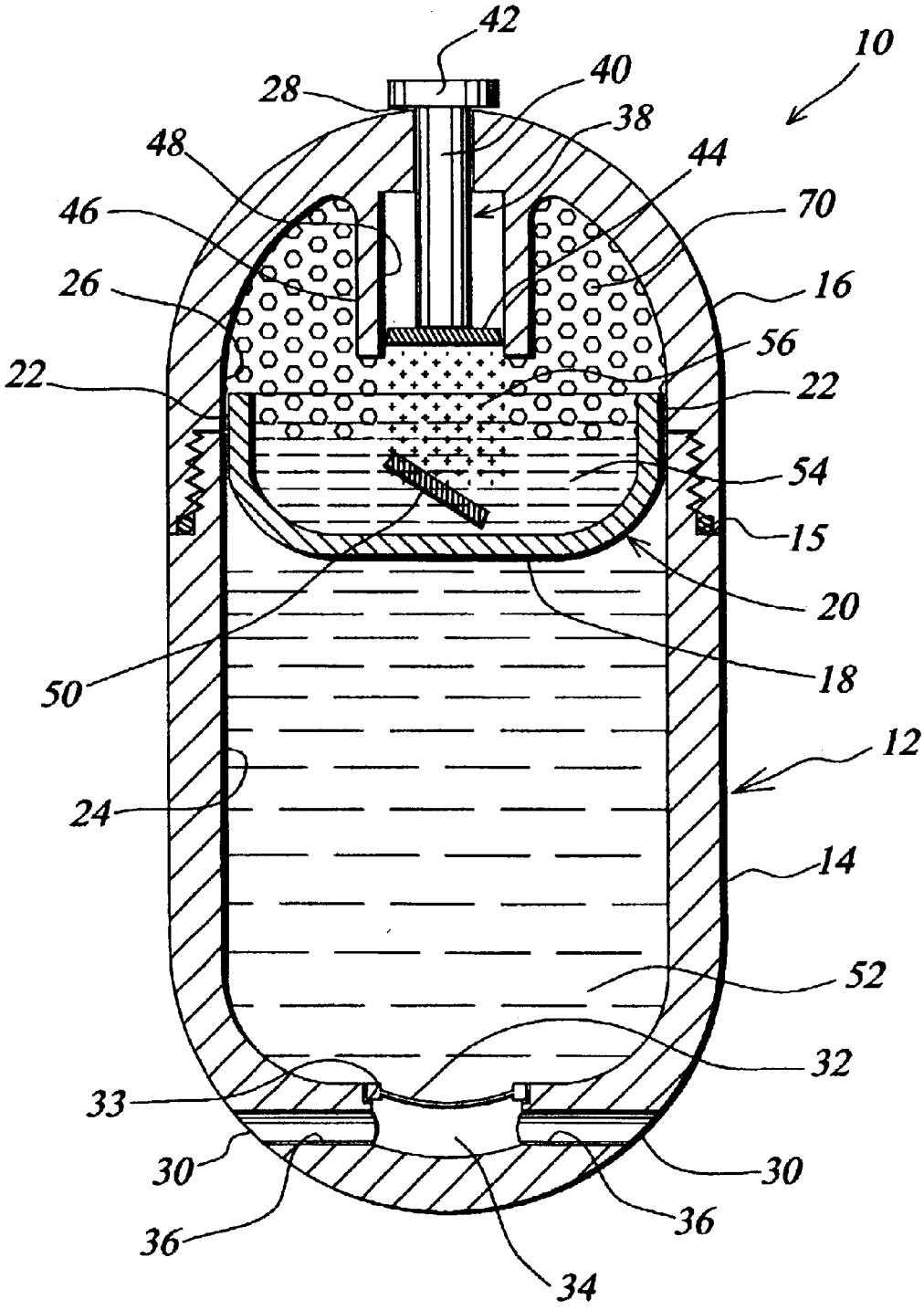
FIG. 2*a* is a sectional elevational view of the grenade of FIG. 1 showing its condition upon actuation by depression of the plunger.
Figure 2B:
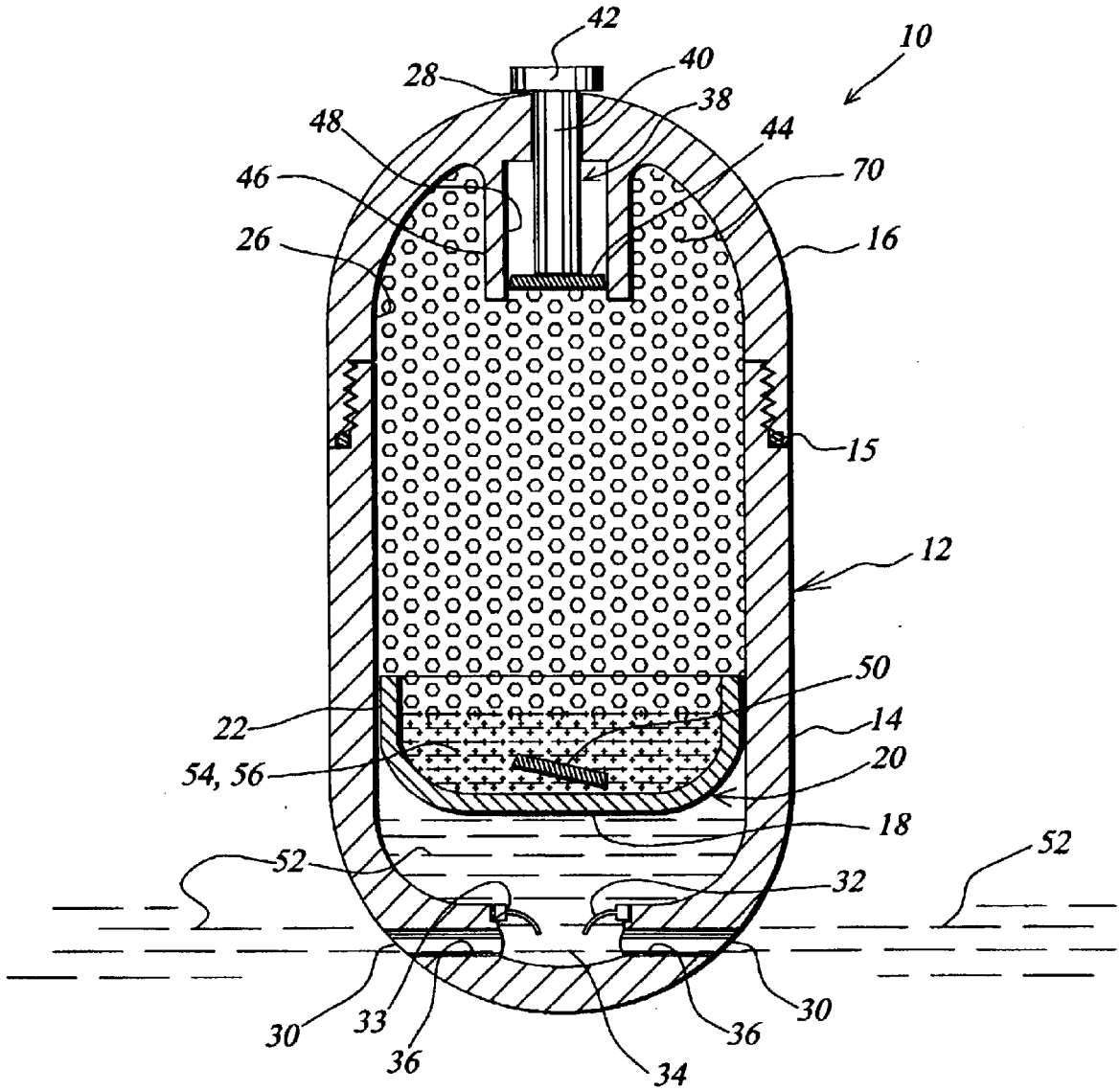
FIG. 2*b* is a sectional elevational view of the grenade of FIGS. 1 and 2*a* shown in a fired condition with paint being expelled through the pair of paint ejection ports provided.

Upon depression of the plunger button 42, the plunger 38 is forced inwardly toward the interior confines of the casing 12, as depicted in FIG. 2*a*. The inward pressure on the plunger 38 forces the piston 44 longitudinally along the length of the barrel 46, ejecting the propellant-isolating plug 50 from the mouth of the barrel 46 and also ejecting the baking soda 56 from the second propellant storage cavity 48. The baking soda 56 falls into the first propellant storage chamber 26, which then serves as a mixing chamber. The baking soda 56 thereupon mixes with the vinegar 54, as illustrated in FIG. 2*a*. This creates a significant quantity of carbon dioxide gas, indicated generally at 70. The chemical reaction is a noncombustive reaction so that it presents no fire or pyrotechnic hazard. Nevertheless, the quantity of carbon dioxide gas 70 generated is substantial enough to create an elevated pressure within the casing 12. As the carbon dioxide is generated, it creates a pressure and expands as illustrated in FIG. 2*b*, since the cup 20 may be forced longitudinally along the length of the cavity defined within the casing 12. The cylindrical annular wall 22 of the cup 20 slides in a fluid-tight, sliding seal relationship with the interior wall of the body member 14.

The floor 18 of the cup 20, which serves as the fluid-tight paint/propellant barrier, exerts a force against the paint 52 sufficient to break the paint seal 32. Preferably, the paint seal 32 is constructed so that it will rupture at a pressure of about forty pounds per square inch. The paint 52 is thereupon expelled under pressure through the plenum 34, through the channels 36, and out of the paint expulsion ports 30 and into the vicinity of the paint grenade 10. Any combatant located within the range of the ejection spray from the paint expulsion ports 30 will be marked with paint.

Following use, the paint grenade 10 may be easily recharged for reuse. This is accomplished by merely unscrewing the body members 14 and 16 from each other, retracting the piston 44 of the plunger 38 back into the end of the barrel 46 closest to the plunger port 28 so that the plunger rod 40 extends fully from the casing 12. Once the plunger rod 40 has been withdrawn, the safety clip 60 is again reattached to it. The user then washes out any remnant of the vinegar and baking soda. The cup 20 is then removed from the casing body member 14 and the broken paint seal 32 is replaced with a new, intact paint seal 32. The body member 14 is then filled with a fresh supply of paint 52 and the cup 20 is then replaced at the upper extremity of the body member 14. The cup 20 is then refilled with a fresh supply of vinegar 54. A fresh charge of baking soda 56 is then poured into the barrel 46 with the body member 16 in an inverted position from that shown in FIG. 1. The plug 50 is then reinserted into the distal extremity of the barrel 46 remote from the plunger port 28 to again seal the propellant component chambers 26 and 48 from each other when the body member 16 is screwed back onto the body member 14. The paint grenade 10 is thereupon again prepared for use. Moreover, it may be used and reused any number of times in the manner described.

It is evident that, unlike conventional paint grenades, the paint grenade 10 does not require charging with a source of compressed air, nor does it require the use of a new compressed air cartridge each time it is used. Furthermore, the reactive propellant components are totally noncombustible, so that the paint grenade 10 is entirely safe to use. It may be charged and recharged at any location in the area in which the mock combat game is conducted. All that is required is for the user to have supplies of vinegar, baking soda, and paint to recharge the reusable paint grenade 10.

FIGS. 3 and 4*a* through 4*d* illustrate another, preferred embodiment of the invention in which the paint 52 and first and second propellant components 54 and 56, respectively, are packaged within encapsulating containers that may be inserted into a grenade casing. Specifically, the paint grenade 110, like the paint grenade 10, is comprised of a rigid oblong casing 112 formed of releaseably engageable body members 114 and 116. The releaseably engageable body members 114 and 116 have mutually engageable threads formed therein with a fluid-tight O-ring seal 115 entrapped between the body members 114 and 116.

The body member 114 is constructed with a paint discharge plenum 134 from which a multiplicity of channels radiate in different directions. Four of these channels, specifically the relatively short channels 136 and the longer channels 137 are visible in the drawing figures. All of the channels lead to a different paint ejection port 130.

One principal difference in construction of the paint grenade 110 from the paint grenade 10 is that the paint 52 is enveloped within a flexible-walled paint storage envelope 125 that conforms to the shape of the portion of the hollow cavity defined within the casing 112 by the lower part of the body member 114. The envelope 125 has a neck 127 that projects downwardly toward the paint dispersion plenum 134 as illustrated. A resilient rubber O-ring 129 is set into the internal wall of the body member 114 to form a fluid-tight seal about the outer circumference of the envelope neck 127. At the interior of the base of the envelope neck 127 there is a thin, rupturable membrane 132 which must broken in order for paint 52 to escape from the envelope 125.

The paint storage envelope 125 has opposing ends. The first end 121 of the envelope 125 forms a fluid-tight paint/propellant barrier. The other end of the envelope 125 terminates in the narrowed neck 127, at the base of which the rupturable paint seal 132 is formed. The envelope 125 defines a paint storage chamber 124 within its structure.

The paint grenade 110 is also provided with a propellant cartridge 141. The propellant cartridge 141 has a first, cup-shaped portion 120 located adjacent the first end 121 of the paint storage envelope 125. The propellant cartridge 141 also includes an opposite, second portion 145 located adjacent a plunger 138.

The cup-shaped portion 120 of the propellant cartridge 141 is filled with vinegar 54 up to, but not above a radially outwardly projecting bearing ledge 151. A propellant component isolation barrier disc 150 is placed across the bearing ledge 151. The propellant component isolation barrier disc 150 may be a thin, stiff, but relatively weak plastic disc, or it may be formed of aluminum foil. In any event, the peripheral edge of the propellant component isolation barrier disc 150 is sealed in fluid-tight fashion to the bearing ledge 151 to isolate the vinegar 54 in the lower part of the cup-shaped portion 120 of the propellant cartridge 141.

In the fabrication of the propellant cartridge 141 a quantity of powdered baking soda 56 is placed atop the propellant component isolation barrier disc 150 once the disc 150 has been sealed to the bearing ledge 151. The baking soda 56 fills the interstitial space above the bearing ledge 151 up to the radially outwardly projecting lip 153 of the propellant cup 120. Another propellant sealing disc 155, preferably also formed of thin plastic or aluminum foil, is placed atop the baking soda 56. The periphery of the propellant-confining disc 155 is sealed to the radial lip 153 throughout, so that the baking soda 56 is sealed in fluid-tight fashion in the upper portion of the cup 120, between the barrier discs 150 and 155.

The propellant component isolation barrier disc 150, together with the bottom 118 of the cup 120, defines a volume of space that may be considered to be a first propellant storage chamber within the propellant cartridge 141. The barrier and confining discs 150 and 155, respectively, together with the upper portion of the cup 120, may be considered to define a second propellant storage chamber within the propellant cartridge 141.

The plunger 138 differs somewhat in construction from the plunger in the embodiment of the invention illustrated in FIG. 1. The plunger 138 includes a solid plunger shaft 140 that extends through a plunger port 128 defined at the upper end of the body member 116. The body member 116 is equipped with a tubular, barrel-shaped structure 146 that surrounds the plunger shaft 140. About midway along its length, the plunger shaft 140 is provided with a longitudinally elongated pressure relief channel 147. A resilient rubber O-ring 149 is set in sliding sealing engagement with the outer surface of the plunger shaft 140 at a location proximate the plunger port 128. A radially directed, O-ring channel is defined in the structure of the body member 116 just inside of the plunger port 128 to seat the O-ring 149.

Near its distal end, remote from the plunger port 128, the interior diameter of the barrel 146 is enlarged to form an annular recess adapted to receive a compressed coil spring 161. The plunger 138 is provided with an annular piercing member 163 that has a plurality of sharp points 165 that are directed toward the upwardly facing end of the propellant cartridge 141. At its upper end the plunger shaft 140 includes a disc-shaped actuator button 142 which has an outer diameter greater than the outer diameter of the plunger shaft 140 and greater than the diameter of the plunger port 128.

Figure 3:
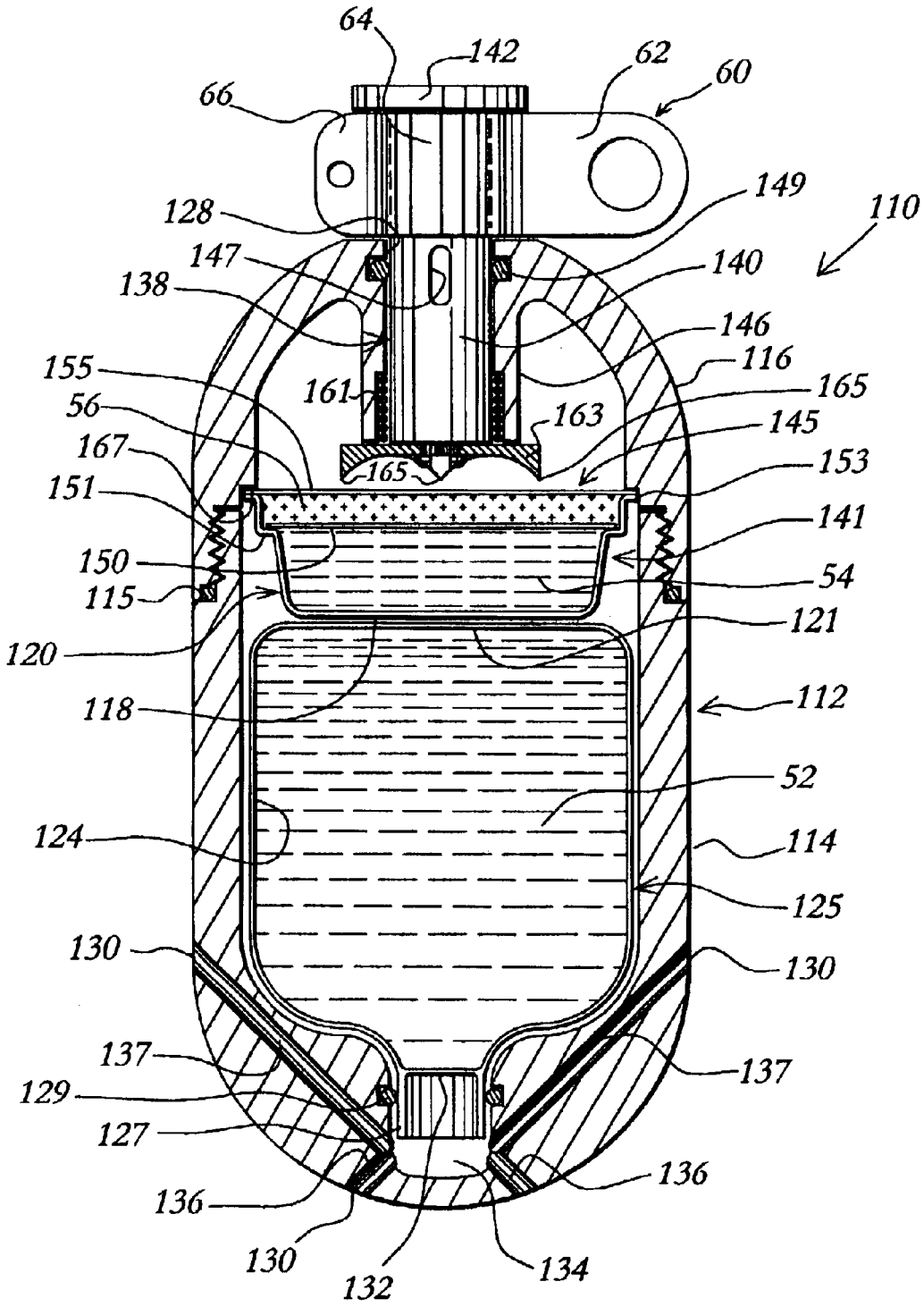
FIG. 3 is a sectional elevational view illustrating another preferred embodiment of the invention employing cartridges for both the paint and for the propellant components shown in a condition recharged for use.

The sharp cutting points 165 on the cutting disc 163 are directed toward the propellant cartridge 141 and toward the propellant component isolation barrier disc 150 therewithin. The spring 161 is compressed so as to bias the plunger cutting element 163 toward the propellant cartridge 141. However, when the paint grenade 110 is loaded, the plunger 138 is retracted so that the plunger shaft 140 protrudes out of the plunger port 128 of the casing 112 and so that the cutting element 163 is retracted away from the propellant cartridge 141. The back face of the cutting element 163 resides in abutment against the distal extremity of the barrel-shaped structure 146 defined on the inner surface of the body member 116. The plunger 138 is held in this position by engagement of the safety clip 60 about the upper, exposed end of the plunger shaft 140, as illustrated in FIG. 3. As long as the safety clip 60 remains in position, the paint grenade 110 will remain in a deactuated condition.

FIG. 3 is a sectional elevational view of the reusable paint-dispersing grenade 110 constructed according to the invention and shown in the loaded, ready-to-use condition. The casing 112 is formed as a hollow, longitudinally elongated structure, closed at both ends, defining within its confines a cavity of generally cylindrical cross section. The ends of the body members 114 and 116, remote from the mutually interengageable threads thereof, are formed in a generally hemispherical shape.

To utilize the paint grenade 110, the casing 112 is loaded with a prepackaged paint envelope 125, filled with paint 52, by positioning the neck 127 thereof downwardly within the surrounding O-ring seal 129, as illustrated in FIG. 3. The propellant cartridge 141 is then loaded into the body member 114 atop the envelope 125 with the floor 118 of the cup-shaped portion 120 bearing downwardly against the upwardly facing end 121 of the paint envelope 125. The plunger 138 is then fully retracted so that the plunger shaft 140 protrudes from the plunger port 128 in the body member 116. The safety clip 60 is then attached to the plunger shaft 140 by grasping the pull tab 62 and forcing the tabs 66 at its other end against the outer surface of the exposed portion of the plunger shaft 140 in a lateral direction. The arms 64 of the safety clip 60 will spread so that the safety clip 60 can be pressed toward the plunger shaft 140. The plunger shaft 140 is then embraced within the lateral confines of the safety clip arms 64 and the physical structure of the safety clip 60 prevents the compressed spring 161 from urging the cutting element 163 toward the propellant cartridge 141.

The body member 116 is then screwed onto the body member 114. A bearing ledge 167, defined in the interior wall of the body member 116 near the threads thereof, longitudinally bears against the peripheral edge of the confining seal 155 and lip 153 of the cup-shaped portion 120 of the propellant cartridge 141. The propellant cartridge 141 is thereby stabilized in a centered condition within the hollow enclosure of the casing 112, directly atop the paint envelope 125 and centered relative to the alignment of the plunger 138.

Figure 4A:
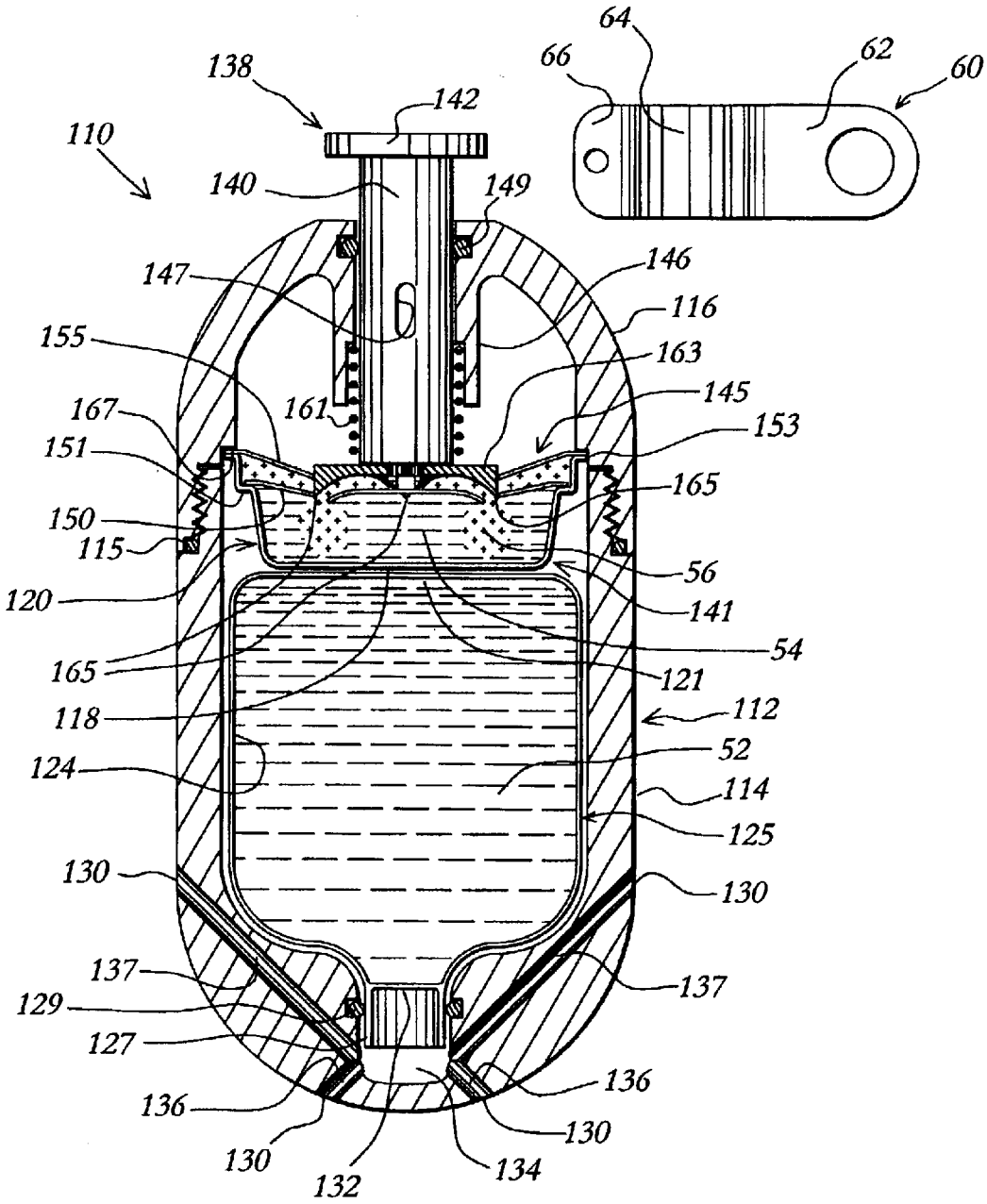
FIG. 4*a* is a sectional elevational view that illustrates the actuation of the embodiment of the paint grenade shown in FIG. 3.

To utilize the paint grenade 110, the safety clip 60 is laterally withdrawn from the plunger shaft 140, as illustrated in FIG. 4*a*. The plunger 138 is thereupon manually depressed to drive the plunger 138 inwardly toward the propellant cartridge 141. The sharp points 165 of the cutting element 163 pierce through both the confining membrane 155 and the propellant component isolating membrane 150, also as illustrated in FIG. 4*a*.

Immediately following removal of the safety clip 60, and upon full depression of the plunger 138, the grenade 110 is thrown. While in flight, the baking soda 56, previously isolated from the vinegar 54, becomes mixed therewith due to the breach of the propellant component isolating barrier 150. As the baking soda 56 mixes with the vinegar 54, a noncombustible gas 70 is generated and fills the portion of the cavity defined within the casing 112 except for that portion of the cavity occupied by the paint envelope 125. Because the plunger shaft 140 has been driven into the interior of the casing 112, there is no path of escape for the gas 70 through the pressure relief channel 147 in plunger shaft 140 since that channel is located interiorly within the confines of the casing 112. Rather, the O-ring 149 is located between the pressure relief channel 147 and the plunger port 128. The O-ring 149 contacts the outer surface of the plunger shaft 140 throughout and prevents the escape of any gas through the plunger port 128.

Figure 4B:
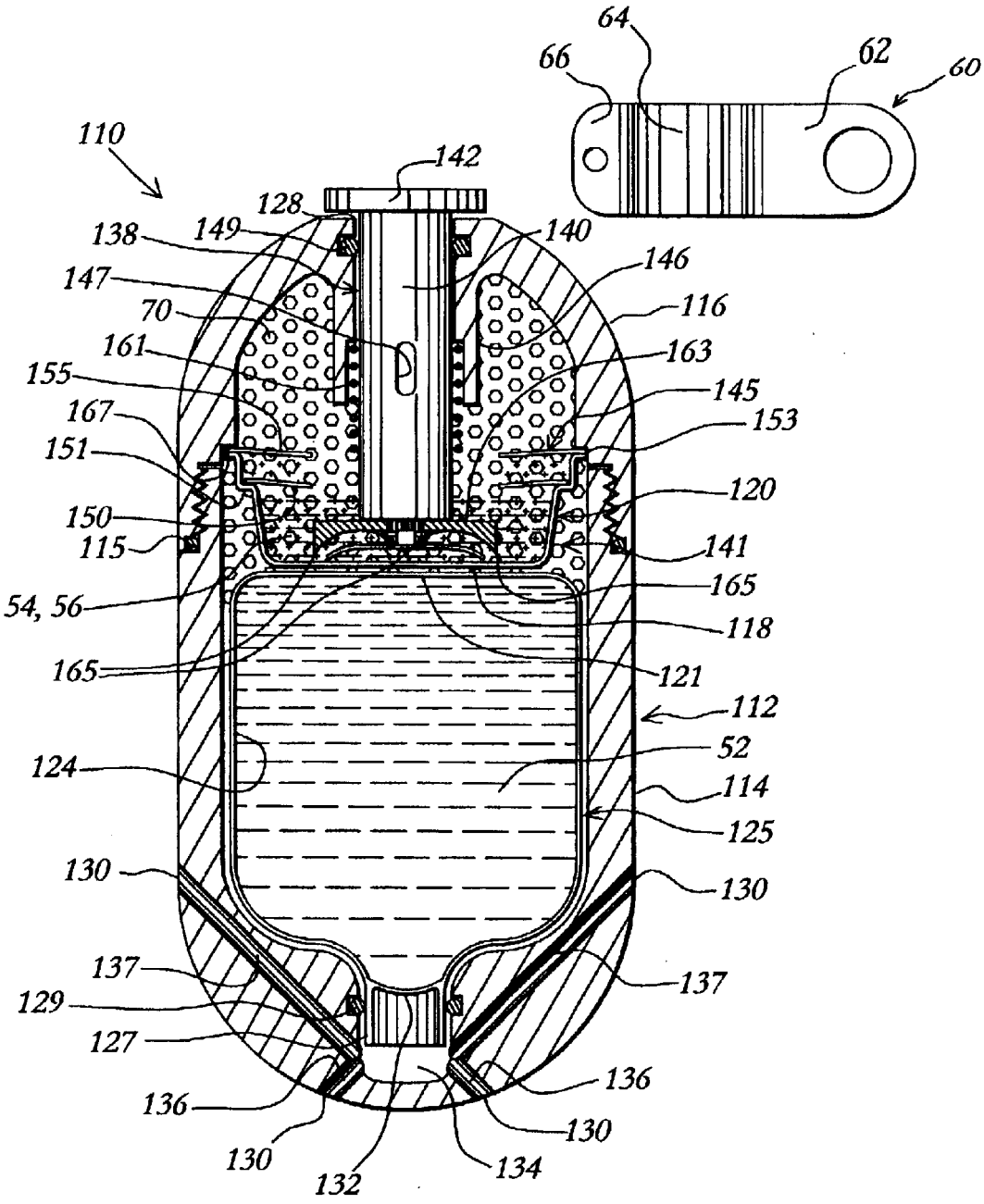
FIG. 4*b* illustrates the initial reaction of the propellant components and the initial buildup of pressure within the reusable paint grenade of FIGS. 3 and 4*a*.

Pressure within the confines of the casing 112 thereupon builds due to the generation of an ever increasing quantity of gas 70, as illustrated in FIG. 4*b*. Ultimately, this pressure is sufficient to force the floor 118 of the propellant cartridge 141 downwardly against the end 121 of the paint envelope 125. It is not necessary for the peripheral edge of the lip 153 to form any type of fluid-tight seal with the interior wall of the casing 112, since the O-rings 149, 115, and 129 prevent the escape of gas from within the confines of the casing 112.

Figure 4C:
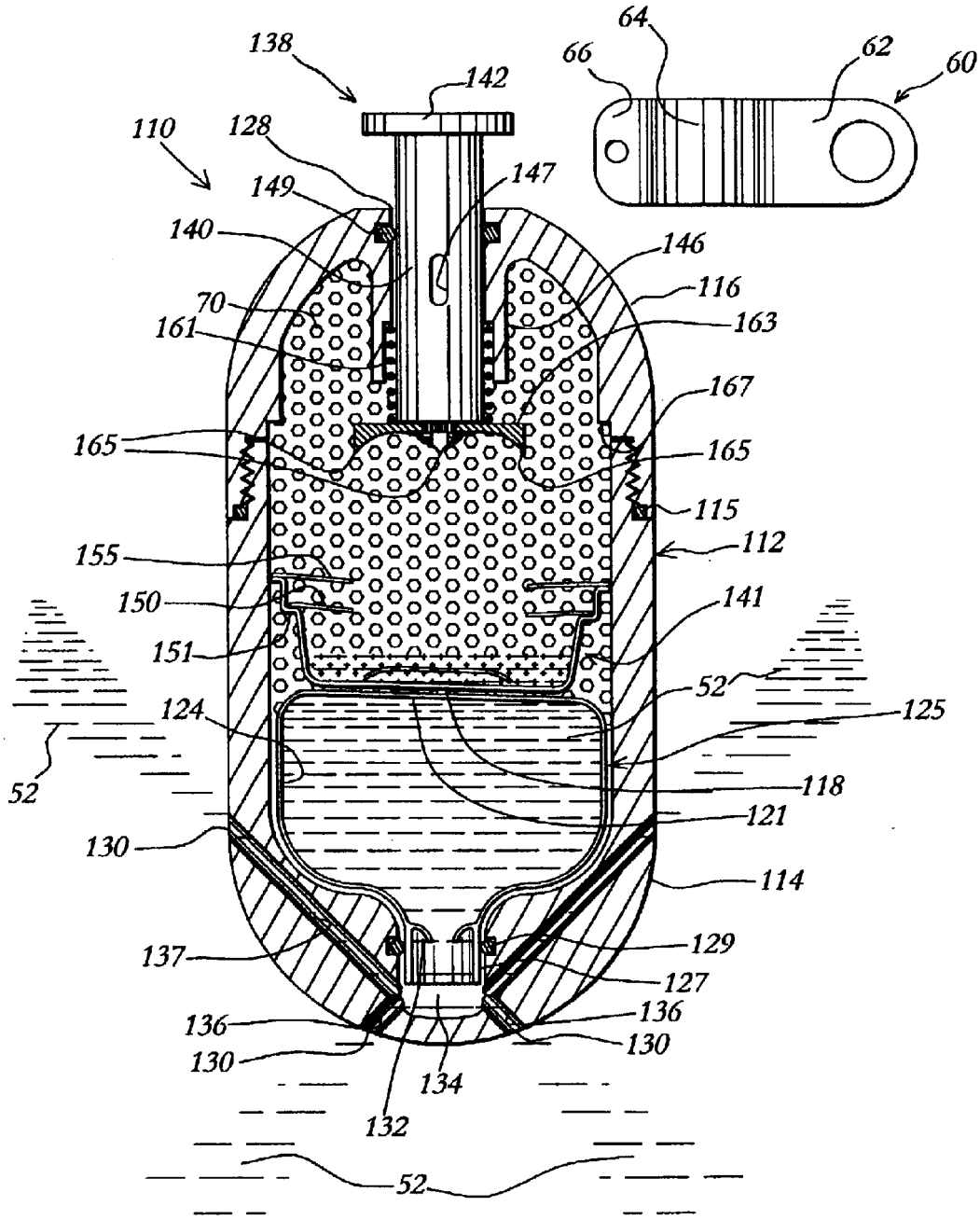
FIG. 4*c* illustrates the firing of the reusable grenade shown in FIGS. 3, 4*a*, and 4*b*.

Pressure builds within the hollow cavity casing 112, preferably to about forty pounds per square inch, until it is sufficient to break the paint seal 132 at the neck 127 of the paint envelope 125. Once the paint seal 132 bursts, paint 52 is ejected under pressure and is dispersed through the channels 136 and 137, out through the paint dispensing ports 130, as illustrated in FIG. 4*c*.

Figure 4D:
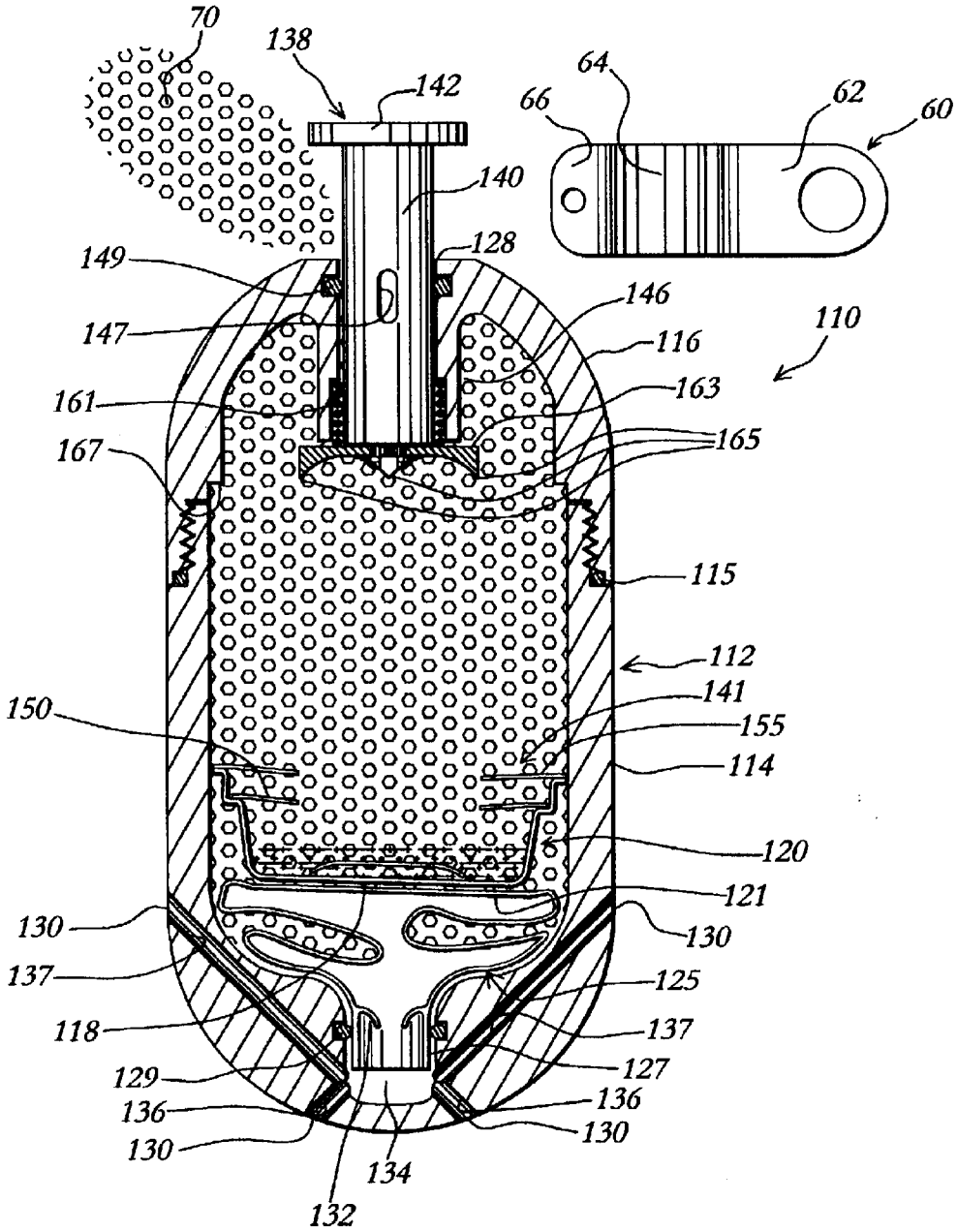
FIG. 4*d* illustrates the release of excess propellant gas from within the confines of the rechargeable grenade of FIGS. 3 and 4*a* through 4*c*.

Following the virtually complete discharge of all paint 52 from within the paint envelope 125, as illustrated in FIG. 4*d*, the pressure within the hollow enclosure of the casing 112 builds sufficiently to force the plunger 138 back toward the plunger port 128 overcoming the bias of spring 161. This forces the plunger shaft 140 out of the casing 112 so as to protrude as illustrated in FIG. 4*d*. Once the plunger 138 has been forced back far enough to the position illustrated in FIG. 4*d*, excess gas 70 can escape past the O-ring 149 through the pressure relief channel 147 when the upper end of the pressure relief channel 147 has cleared the O-ring 149. As a consequence, excess pressure build up is relieved from within the casing 112. Thereafter, the safety clip 60 can then be reengaged on the plunger shaft 140.

Unlike the paint grenade 10, the paint grenade 110 does not have to be cleaned following each use. To the contrary, it is only necessary to unscrew the body members 112 and 114 from each other, remove the spent cartridge and paint envelope, insert a fresh paint envelope 125 down into the lower end of the body member 114, place a fresh, unused propellant cartridge 141 on top of the paint envelope 125, and reengage the threads of the body members 114 and 116. Even if there are remnant amounts of the reactive propellant components left within the enclosure of the casing 112, the paint grenade 110 will not be actuated prematurely. To the contrary, any pressure buildup will be relieved by the escape of gas from within the enclosure of the casing 112, longitudinally through the pressure relief channel 147 and between the O-ring 149 and the plunger port 128.

Figure 5:
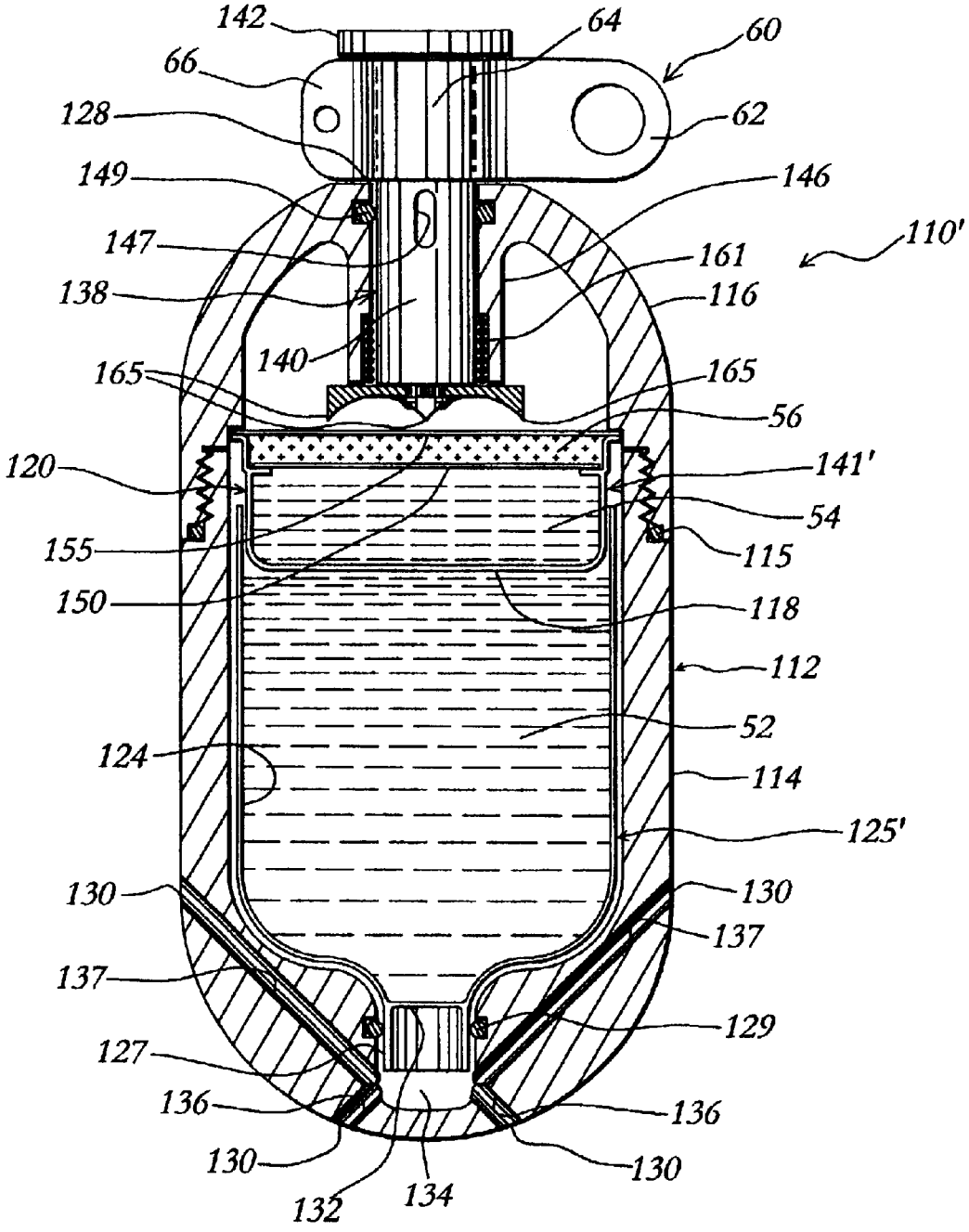
FIG. 5 illustrates a modification of the reusable paint grenade of FIGS. 3 through 4*d* shown charged in a condition ready for use.

FIG. 5 illustrates a modification of the paint grenade 110 illustrated in FIGS. 3 and 4*a*–4*d*. The paint grenade 110' shown in FIG. 5 employs most of the same component elements as the paint grenade 110 and those same elements bear the same reference numbers. However, in place of the encapsulating envelope 125 having a closed upper end, the paint grenade 110' employs a flexible walled paint container 125', the upper end of which is adhesively sealed throughout its circumference to the side of the cup-shaped portion 120 of the propellant cartridge 141'. The bottom 118 of the cup-shaped portion 120 thereby closes the upper end of the paint container 125'.

The paint grenade 110' is loaded and reloaded in the same manner as the paint grenade 110. The difference in structure is that the bottom 118 of the cup-shaped portion 120 forms a closure at the upper end of the paint container 125'. Therefore, the paint container 125' and the propellant cartridge 141' are joined together and inserted into the casing 112 as a unit. The operation of the paint grenade 110' is otherwise the same as that of the paint grenade 110.

Figure 7:
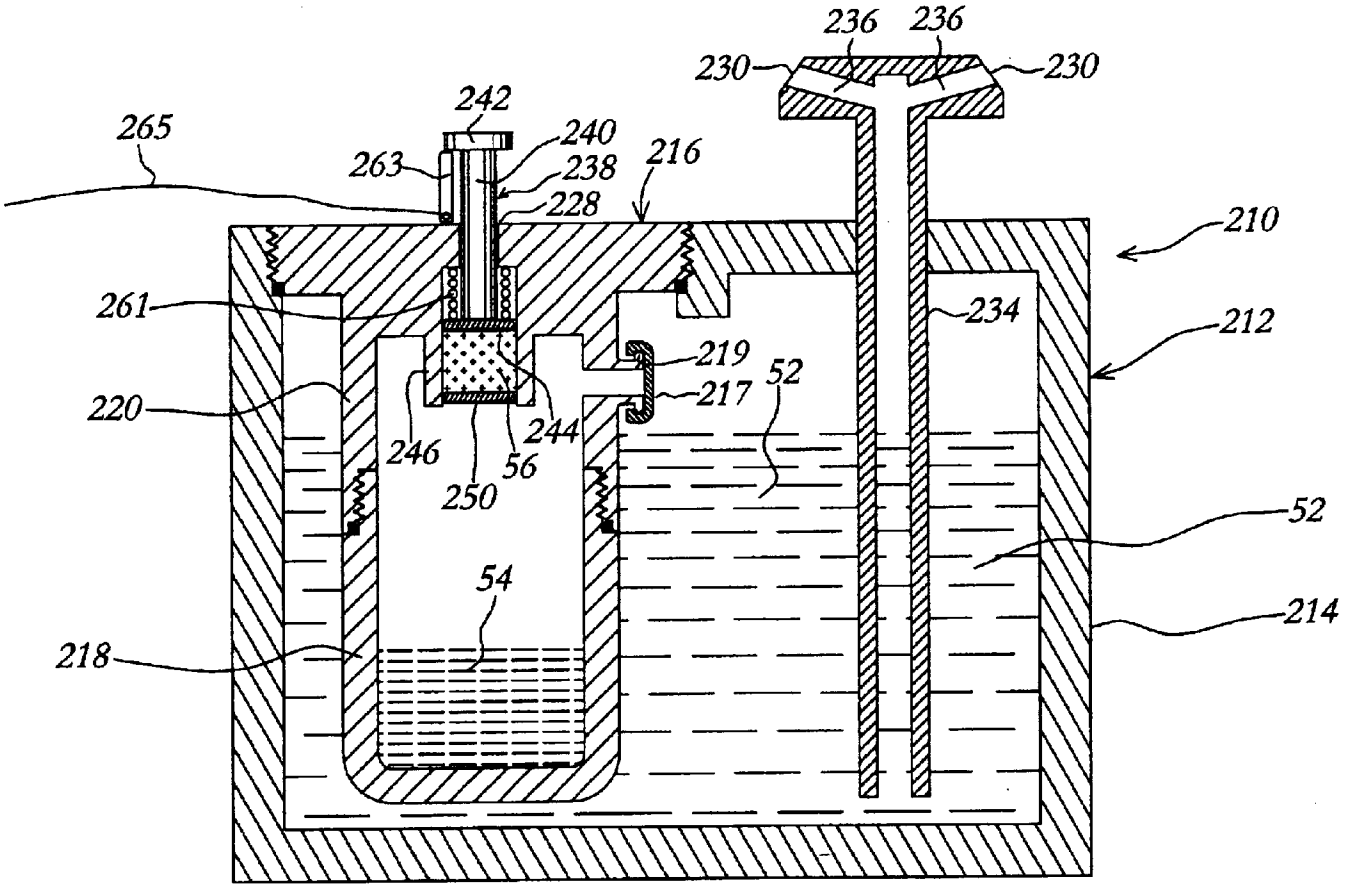
FIG. 7 is a sectional elevational view of a paint grenade according to the invention which is constructed for remote actuation.

A paint grenade can also be constructed according to the invention for remote actuation as illustrated in FIG. 7. In this embodiment, the paint grenade 210 is configured for remote detonation. The paint grenade 210 employs a casing 212 having a first body member 214 into which a second body member 216 is screwed. A quantity of paint 52 is poured into the body member 214. The second body member 216 serves as another form of propellant cartridge in which a lower propellant cup section 218 containing vinegar 54 is screwed into an upper propellant cap section 220, which in turn is threadably engaged with threads in the first body member 214. The first body member 214 thereupon surrounds the second body member 216.

The second body member 216 has a plunger 238 that is equipped with a solid plunger rod 240 having an actuator button 242 at its upper extremity, and a piston 244 at its lower extremity. A hollow barrel 246 is defined in the underside of the upper cap section 220 of the second casing body member 216. A compressed spring 261 is positioned to urge the plunger 238 inwardly toward the interior of the casing 212. However, the spring 261 is compressed so that the plunger rod 240 projects upwardly from the casing 212.

A plunger retainer 263 is provided and is interposed between the underside of the actuator button 242 and the top of the cap section 220 of the second body member 216. The plunger retainer 263 holds the plunger retracted in a condition in which the plunger rod 240 is extended out of a plunger port 228 in the upper surface of the propellant cap section 220. The plunger retainer 263 may be withdrawn by remote actuation by jerking on a flexible line 265.

When the plunger retainer 263 is withdrawn, the coil spring 261 urges the plunger piston 244 downwardly longitudinally through the barrel 246. The downward force of the plunger 238 pushes the propellant component isolating plug 250 out of the barrel 246, thus allowing the baking soda 56 to drop down into the vinegar 54. These propellant components react to produce a gas that fills the sealed cavity defined within the second body member 216 with a gas under pressure.

The pressure ultimately builds to an extent sufficient to blow out the paint propellant barrier seal 217, which may be a rubber cap elastically engaged upon the rim of a laterally directed port 219. The pressure of the gas generated within the cavity of the body member 216 acts upon the marking paint 52, forcing it up the ejection tube 234 and out through a plurality of ducts 236. Paint is thereupon sprayed in the directions of alignment of the ducts 236 through outlet ports 230.

Undoubtedly, numerous variations and modifications of the invention will be readily apparent to those familiar with paint ball games and mock competitions and the devices used in them. For example, numerous different propellant isolating systems and paint ejection arrangements may be substituted for those illustrated is the embodiments depicted. Also, a safety clip device constructed and operating more similarly to the safety pin of an actual military ordinance hand grenade may be substituted for the safety clip 60 shown in some of the embodiments illustrated. In addition to being used as a device in mock combat, the paint grenade of the invention may also be used by law enforcement officers where a nonincendiary, not lethal grenade-type device is desired. For example, tear gas may be used in place of the paint described in the foregoing examples. Accordingly, the scope of the invention should not be construed as limited to the specific embodiments depicted and described, but rather is defined in the claims appended hereto.

I claim:

1. A reusable paint grenade comprising a rigid, reusable casing defining a hollow cavity therewithin and defining at least one paint ejection port and a plunger port and said hollow cavity is subdivided into a paint storage chamber, a first propellant compartment storage chamber, and a second propellant component storage chamber, a fluid-tight paint/propellant barrier separating said paint storage chamber from said first propellant component storage chamber, a fluid-tight propellant component isolation barrier separating said first and second propellant component storage chambers from each other, first and second propellant components located respectively in said first and second propellant storage chambers, and said first and second propellants, when mixed react without combustion to form a gas that is under pressure in said casing, a plunger mounted in said casing and projecting from said plunger port and directed toward said second component storage chamber, whereby depression of said plunger into said casing breaches said propellant component isolation barrier, and a breachable paint seal separating said paint storage chamber from said at least one paint ejection port.

2. A reusable paint grenade according to claim 1 further comprising a flexible paint storage envelope located within said propellant cavity to define said paint storage chamber therewithin, and said paint storage envelope has opposing ends, a first of which forms said fluid-tight paint/propellant barrier and the other of which forms said rupturable paint seal.

3. A reusable paint grenade according to claim 2 further comprising a propellant cartridge having a first portion located adjacent said paint storage envelope, and a second portion located adjacent said plunger, and said propellant component isolation barrier extends across and is located within said propellant cartridge, thereby defining said first and second propellant storage chambers within said propellant cartridge.

4. A reusable paint grenade according to claim 3 wherein said plunger is equipped with a sharp cutting element directed toward said propellant cartridge and toward said propellant component isolation barrier therewithin, whereby depression of said plunger into said casing drives said cutting element through said propellant component isolation barrier thereby bringing said propellant components into contact with each other.

5. A reusable paint grenade according to claim 4 further comprising a spring that biases said plunger cutting element toward said propellant cartridge.

6. A reusable paint grenade according to claim 1 further comprising a plunger-restraining device that is releaseably attachable to said plunger to limit movement of said plunger toward said second propellant component storage chamber.

7. A reusable paint grenade according to claim 1 further comprising a plurality of paint ejection ports as aforesaid, and said rupturable paint seal is positioned between said paint storage chamber and all of said paint ejection ports.

8. A reusable paint grenade according to claim 1 further comprising a propellant cartridge located in said hollow cavity and said propellant cartridge includes a cup having a mouth opposite a floor that forms said fluid-tight paint/propellant barrier, and said fluid-tight propellant isolating barrier extends across said cup between said mouth and said floor, whereby said first propellant component storage chamber is formed within said cup between said floor thereof and said propellant isolating barrier, and further comprising a paint storage liner located within said hollow cavity to define said paint storage chamber therewithin, and said paint storage liner has opposing ends, one of which is closed by said floor of said cup and the other of which is provided with said breachable paint seal.

9. A reusable paint grenade comprising a hollow casing defining a cavity therewithin which is formed by releaseably engageable body members, and which has at least one paint expulsion port and a plunger port, a movable fluid-tight paint/propellant barrier within said hollow casing that delineates a paint storage chamber from a first propellant component storage chamber within said cavity, a paint seal between said paint storage chamber and said at least one paint expulsion port, a fluid-tight propellant component isolation barrier within said hollow casing that delineates a second propellant component storage chamber from said first propellant component storage chamber within said cavity, a plunger that is mounted within said cavity and which protrudes from said plunger port of said casing and which is directed toward said second propellant component storage chamber, a first propellant component located within said first propellant component storage chamber, a second propellant component located within said second propellant component storage chamber, and a quantity of paint located within said paint storage chamber, whereby said plunger is depressible externally from said casing to breach said propellant component isolation barrier, whereupon said first and second propellant components contact each other and chemically react to expand against said movable fluid-tight paint/propellant barrier, thereby breaching said paint seal.

10. A reusable paint grenade according to claim 9 wherein one of said propellant components is comprised of an acid and the other of said propellant components is comprised of a base so that when said propellant components contact each other they react chemically to create a gas under pressure.

11. A reusable paint grenade according to claim 10 wherein said one of said propellant components is comprised of acetic acid and said other of said propellant components is comprised of sodium bicarbonate.

12. A reusable paint grenade according to claim 10 wherein said paint is located within said hollow cavity between said paint seal and said paint/propellant barrier and further comprising a cup forming said first propellant component storage chamber and located in said hollow cavity and having a floor that forms said movable fluid-tight paint/propellant barrier and a mouth opposite said floor.

13. A reusable paint grenade according to claim 12 further comprising a propellant packet secured across said mouth of said cup, and said packet is formed with a rupturable skin that serves as said fluid-tight propellant component isolation barrier.

14. A reusable paint grenade according to claim 12 wherein said plunger carries a piercing member that pierces said skin of said packet when said plunger is advanced into said hollow cavity.

15. A reusable paint grenade according to claim 9 wherein said releaseably engageable body members have mutually engageable threads formed therein with a fluid-tight O-ring seal entrapped between said body members.

16. A reusable paint grenade according to claim 9 further comprising a plurality of paint ejection ports as aforesaid, and said breachable paint seal is rupturable and is positioned between said paint storage chamber and all of said paint ejection ports.

17. A reusable paint grenade comprising:

a rigid reusable casing defining a hollow cavity therewithin and formed of first and second mating, releaseably engageable casing body members and including at least one paint ejection port and a plunger access port in said casing, a paint/propellant separation barrier located within said hollow cavity and which subdivides said hollow cavity into a marking paint chamber filled with an incompressible volume of marking paint and a propellant mixing chamber containing a first propellant component and said propellant mixing chamber is sealed fluid tight from said marking paint chamber, a fluid-tight propellant component separation barrier defining within said hollow cavity a second propellant component chamber containing a quantity of a second propellant component and sealed fluid-tight from said propellant mixing chamber, and wherein, when said first and second propellant components contact each other, they react noncombustively to produce a gas that exerts pressure upon said paint/propellant separation barrier, a plunger projecting from said plunger access port and directed toward said second propellant component chamber, whereby rapid advancement of said plunger into said second propellant component chamber unseals said second propellant component chamber and said propellant mixing chamber from each other, thereby allowing said propellant components to mix together to produce an expanding gas that exerts sufficient pressure upon said paint/propellant separation barrier to breach said paint seal, thereby causing said marking paint to be ejected from said casing through said at least one paint ejection port.

18. A reusable paint grenade according to claim 17 wherein said first propellant component is comprised of vinegar and said second propellant component is comprised of baking soda.

* * * * *